US005636704A

United States Patent [19]

Castaneda

[11] Patent Number: 5,636,704

[45] Date of Patent: Jun. 10, 1997

[54] ASCENDER FOR A ROOFING SAFETY SYSTEM

[76] Inventor: Frank F. Castaneda, 212 University Dr., Lubbock, Tex. 79401

[21] Appl. No.: 513,303

[22] Filed: Aug. 10, 1995

[51] Int. Cl.[6] ..... A62B 1/14

[52] U.S. Cl. ..... 182/5; 182/192; 188/65.2; 24/134 R

[58] Field of Search ..... 182/45, 3, 5, 192; 24/134 R; 188/65.2

[56] References Cited

U.S. PATENT DOCUMENTS

| | | | |
|---|---|---|---|
| 822,658 | 6/1906 | Emberson . | |
| 1,152,685 | 9/1915 | Winn et al. . | |
| 1,363,864 | 12/1920 | Grush . | |
| 2,871,927 | 2/1959 | Materi . | |
| 3,317,971 | 5/1967 | Moyer | 182/5 |
| 3,852,942 | 12/1974 | Healy | 182/5 |
| 4,059,871 | 11/1977 | Swager | 182/5 |
| 4,607,724 | 8/1986 | Hillberg . | |
| 5,143,170 | 9/1992 | Hunt et al. . | |
| 5,282,597 | 2/1994 | Babcock . | |
| 5,287,944 | 2/1994 | Woodyard . | |
| 5,361,558 | 11/1994 | Thornton et al. . | |

OTHER PUBLICATIONS

"Roof Anchors", Advertising Material of DBI/SALA, P.O. Box 46, Red Wing, MN 55066, pp. 1–4, Date Unknown.

Applicant has a co–pending application entitled "Roofing Safety System" filed Aug. 10, 1995, serial No. 08/513,304.

Applicant has a co–pending application entitled "Anchor for a Roofing Safety System" filed Aug. 10, 1995, serial No. 08/513,602.

Applicant has a co–pending application entitled "Foot Step Anchor for a Roofing Safety System" filed Aug. 10, 1995, serial No. 08/513,340.

Applicant has a co–pending application entitled "Crown Anchor for a Roofing Safety System" filed Aug. 10, 1995, serial No. 08/513,410.

*Primary Examiner*—Alvin C. Chin-Shue

*Attorney, Agent, or Firm*—Novak Druce Reynolds Burt

[57] ABSTRACT

A roofing safety system having several components that when installed in various combinations permits access to all locations on the roof's surface and allows roofing personnel to be continuously secured to the safety system from the time the roofer leaves the ground to do a roofing job until he descends back to the ground when the job is finished. Included is a one-way ascender having a substantially cylindrical body that has an interior surface and an exterior surface. The body also has two open ends, one opposite the other. The two open ends establish an entrance port and an exit port through which a safety rope is insertable through the body. There is a ratchet member for allowing the rope to pass in a direction from the insert port to the exit port and for restraining movement of the rope in an opposite direction from the exit port to the insert port. A rope conduit sized to accommodate a safety rope is formed within a substantially cylindrical interior space of the ascender body. A pivot pin and a restraining pin are located upon the ratchet member at an interior end of the ratchet member and within the rope conduit.

9 Claims, 4 Drawing Sheets

ASCENDER FOR A ROOFING SAFETY SYSTEM

FIELD OF THE INVENTION

This invention relates to construction safety systems. More particularly, it relates to a roofing safety system and its various components that permit a roofer to be continuously secured to a roof while working thereupon.

BACKGROUND OF THE INVENTION

The need for safety systems for pitched roofs has long been recognized. For obvious reasons, it is important to secure roofing personnel while they are distantly located above the ground for the purpose of installing new roofs or for repairing existing roofs. Because serious bodily harm may be caused to a roofer should he or she fall from the roof of even a single story building, safety systems have been provided and are now required by government regulations under certain conditions. The stringency of the regulations is changing at all times, however, the thrust of the requirements are to maintain continuous securement between the roofer and a roofing safety system. With such systems in place, it is possible to prevent or break a roofer's fall should that roofer slip or for other reasons loose control while on the roof's surface. It is anticipated, that a roofer may be at risk of suffering injury anytime he is above the ground. For that reason, it is a highly desirable feature of roofing safety systems to provide securement means that may be utilized from the time the roofer leaves the ground in his ascension up to the roof, during his traversals there upon, and finally through his descent back to the ground from the roof.

Certain components of most roofing safety systems are standard, or at least known by most persons skilled in the art and involved in the roofing industry. Typically, an anchor means will be provided upon the roof and to which a roofer maybe connected. Examples of such anchors are shown in previous patents. An example of such an anchor is found in U.S. Pat. No. 5,361,558 to Thornton et al for a roof mountable safety line anchor. Therein, disclosure is found of an anchor that may be installed on a peaked roof. The anchor has an attachment means to which a safety line is connected for securement to the roof. As described therein, the safety line anchor of the Thornton patent is constructed from steel having a central point that may be bent to accommodate the peak of a roof. The legs of the anchor, however, remain substantially rigid with each of the two legs extending down from the roof's peak. A Roof Mounted Anchor Used Singly Or With Another, And With Other Equipment In a Fall Restraint and/or Fall Arrest System is disclosed in U.S. Pat. No. 5,287,944 to Woodyard. Therein, multiple anchors are shown that may be attached to a roof's peak and a cable extended therebetween. The anchors are configured to be attached to the roof's peak, however, and each is rigidly configured so that it accommodates only a specifically pitched roof. As a result, different anchors have to be used on differently pitched roofs because the configuration of the mountings of the Woodyard anchors are not variable. This prevents a single anchor from being used on inconsistently pitched roof peaks.

A common deficiency realized in currently available systems is an inability to secure the initial roofer who must install the anchoring components during original installation. That is, when the anchor is originally installed upon the roofs peak, the roofer has to initially ascend the roof unsecured. During that time, he or she is at risk of suffering an unprotected fall until connection of the anchor to the roof is achieved and the roofer is secured thereto. In any event, no systems are known that include means for protecting a roofer from the time he leaves the ground until he returns thereto. Nor has a system been discovered that permits access to any and all locations upon a given pitched roof.

Certain components of roofing safety systems have been previously disclosed and are known to those involved in the roofing industry. As an example, it is well known for a roofer to wear a body harness to which a safety line or rope may be attached. Typically, the distal end of that rope from the roofer has an attachment mechanism, often embodied in a latching hook, that may be attached to anchoring devices on the roof.

In summary, in view of known systems, several of which have been described herein above, the need for a roofing safety system to which a roofer may be continuously secured while off the ground has been recognized. Furthermore, it has been found that components of such a safety system may offer unique features and benefits that have not previously been achieved either at the component level, or in various combinations with each other.

SUMMARY OF THE INVENTION

This invention includes components that have been invented and selected for their individual and combined benefits and superior performance as a roofing safety system. The system includes multiple components that individually and singularly have new and novel features in and of themselves. Each of the individual components, however, work in association with, and are optimally mated to the others. Together, they yield an overall safety system that has superior collective effectiveness in providing protection to roofing personnel at all times during a roofing job.

The primary benefits of the safety system and its components are its effectivity and ease of installation and use. The first step in assembling the roofing safety system of the present invention is to install the stair step system on a pitched roof. A roofer climbs up to the roof eave on a ladder with several step anchors either in hand or connected to his person. The step anchors are configured so that they are easily stacked together in a compact fashion to facilitate their transport and storage. While still on the ladder, the roofer nails the first two steps to the roof's surface near the eave and ladder. The locations of these two steps are normally within arms reach of the roofer. This begins the series of steps from the roof's edge, at the eave, upwardly toward the roof's crown. Because the step anchors are going to be used similarly to stairs by the roofers, the individual steps are arranged in an alternating manner about an imaginary center line from the eave to the crown. That is, consecutive steps are located on alternating sides of the centerline so that every other step is on the same side of the centerline. The spacing of the steps is such that the average roofer using the system will be able to negotiate the step series in a natural manner without having to take exaggeratedly small steps that may cause him to loose his balance or too large of steps that will likewise cause instability in the roofer. The spacing is completely adjustable since each step anchor is individually attached to the roof and therefore the spacing and orientation can be customized if required. In any event, the spacing should be such that ascending and descending the pitched roof is both comfortable and stable for the roofers.

As the roofer progresses through the installation of the stair step system, he must maintain a connection between himself and the safety system at all times. This is accomplished by having at least two safety lines connected to a harness worn by the roofer. The safety lines are normally of the same length, and each is typically about six feet long. One end of each line is connected to the harness by various means which is not critical as long as it is reliable. A distal end of the safety line from the roofer normally includes a personnel hook that is readily clipped to and released from the several components of the safety system. These safety lines having hooks and lanyards are commercially available and commonly used in the roofing industry. The hook typically includes a spring biased latching member that prevents the hook from inadvertently disengaging from an anchor or other safety system member.

After the first two steps are secured to the roof, one of the safety lines is connected thereto. The roofer then mounts the roof and installs several more step anchors up the roof in series for as far as he can comfortably reach. The second safety line is then connected to the upper most step that has been installed and the first line is released. The roofer then climbs up the roof on the steps he has just installed and attaches another set in a similar fashion. This procedure is repeated until the roofer has ascended to the desired location, which is typically the peak or crown of the pitched roof.

As the roofer moves from step to step, his weight is fully supported upon the step engaging surfaces which are angled upwardly from the pitched surface to provide a foot hold for the roofer. The angle of the step's engaging surface is great enough that the roofer feels securely braced from slipping down the roof, but is not so great that the foot must unduly bend when planted thereon.

One beneficial feature of the step anchors of the present invention are the footed braces that fortify the step when a roofer's weight is applied. The weight of the roofer is supported by the arched portion of the step so that the step does not tend to rock backward toward the eaves, thereby pulling upward on the nails that are securing the step to the roof and possibly disengaging them.

An additional advantage of the step anchor is the inclusion of securing apertures that have a generally keyhole shape; that is, a slot with bulbous or expanded end. The keyhole configuration is utilized because headed nails are the preferred securing members used in the apertures. When installing a step anchor, the base plate of the anchor is positioned at the location upon the roof's surface to which anchorage is desired. A nail is then hammered into the keyhole at the slot's distal end from the expanded bulb. The slot is properly sized so its width is sufficiently broad to allow the nail's shaft to pass therethrough, but also sufficiently narrow to prevent the nail's head from passing. In this manner, when the nail is fully depressed and the flange of the head firmly abuts the top surface of the base plate, the base plate is secured to the roof and prevented from raising therefrom.

In use, the securing apertures are arranged so that the slot is oriented opposingly to the direction at which lateral forces are expected to be applied, while the expanded bulb is arranged toward those forces. In this way, the securing nails are always trapped in the restrictive slot during use while roofers are counting on the anchors to counter and secure against possible falls down and off of the roof. As an example, in the instance of the step anchors upon which forces are applied in a generally downward direction along the pitched roof's surface, the keyhole is oriented with the slot most upwardly and opposite the direction of the force while the expansion is located at the lower end of the aperture in the direction of the force. The benefits of the securing aperture's keyhole configuration is fully realized upon removal of the step anchor from the roof. To disengage the step anchor from the roof, the base plate is raised slightly from the roof by any suitable means. In most cases, the roofer will have a claw hammer handy that may be used to pry the base plate upwardly from the roof thereby pulling the securing nails upward with it. The base plate may then be urged in a direction that causes the nail's head to move from over the narrow slot to over the expanded end. The aperture at the expanded end is sufficiently large that the head passes readily therethrough, releasing the step anchor from the roof. The nails may then be pulled from the roof, but preferably are hammered fully into the roof so that the heads are flush with the roof's upper surface. In this way, any holes that may have been created through the roof in the securing process are plugged by the nails themselves.

Once the crown of the roof has been reached, the roofer installs a roofing crown anchor assembly if a large portion of the roof is going to be traversed during the roofing job. Optionally, if only a more localized area of the roof requires access, additional step anchors may be installed laterally across the face of the roof to that location. These situations will normally occur during repair jobs, as opposed to installations of new roofs. The roofer will traverse the steps using them as foot holds until the location of interest is reached. The roofer may then work around individual roofing anchors at distances governed by the length of the safety line by which he is connected to the anchor. If required, additional steps may be progressively installed until the entire area of the roof needing repair has been attended.

In instances that require a roofing crown anchor assembly, the end anchor assemblies and crown anchor ropes will be carried by the roofer to the crown. The end anchor assemblies are utilized in pairs, therefore the installer gathers end anchor assemblies in sets of two; the number of sets to be determined by the length of the crown that must be traversed. The first end anchor assembly is laid over the roof's crown so that one end anchor is on the near side of the crown and the other is on the opposite, or far side of the crown. The location of the first end anchor assembly is normally near the top or crown end of the series of roofing step anchors. The location must, however, be within the reach of the roofer while he is still secured to the stair step system. Therefore, the position will be at a distance approximately equal to or less than the length of the roofer's safety line.

In installation of the crown anchor assembly over the roof's crown, the connecting crown spanning nylon webbed belt is fully extended between the end anchors and conforms to the apex of the crown over which it is stretched. It should be noted that the end anchors are preferably positioned so that the base plate of each is oriented to the outside end of the crown anchor assembly and the engagement plates having the engagement apertures are oriented toward the interior of the assembly. It is expected that a predominance of the forces applied to the end anchors will be inward toward the opposite end anchor assembly. Therefore, the securing apertures, which are similar to those described with respect to the step anchors, are oriented so that the slot of the keyhole points away from the engagement plate. The second end anchor assembly of the pair is installed in a similar manner as the first, but in a mirrored orientation so that the engagement plates of the two end anchor assemblies are pointed one toward the other. The second end assembly is positioned at a distance from the first that allows the roofer to remain secured to the first end assembly while attaching the second. If the crown anchor ropes are of a fixed length, then the end assemblies will be properly positioned with a distance therebetween approximately equal to the ropes' length. When both end assemblies are secured to the roof, the crown anchor ropes are connected therebetween at respective engagement apertures in the engagement plates of the end anchors. Because the end anchors are on opposite sides of the crown, so are the connected crown anchor ropes.

Additional crown anchor assemblies may be added in series down the crown of the roof if required to reach all areas of interest on the roof. Each subsequent anchor assembly is installed in a similar manner as the first, however, the installation process of each subsequent assembly begins from the second end anchor assembly of the previously installed crown anchor, as opposed to beginning from the stair step system. When the last crown anchor assembly has been installed, two crown anchor spanning ropes are connected between the far distal ends of the crown anchor assembly series. Like the crown anchor ropes, the crown anchor spanning ropes are on opposite sides of the roof's crown.

After one or more crown anchor assemblies have been installed, additional roofers may join the installer since there are now suitable connections for multiple workers that will allow each to work out of the others' way. Therefore, the installer now installs a security rope along side the series of stair steps. Alternatively, the security rope could be installed as soon as installation of the stair step system is completed. This would allow use of the security rope during the installation process of the roof crown anchor assembly by the installing roofer.

In any event, the security rope is usually connected at a top end to an end anchor of the crown assembly that is properly positioned with respect to the stair steps. Alternatively, the top end of the security rope may be connected to any roofing anchor that is properly positioned above the stepping system. One benefit derived from the security rope is that it provides a steadying hand hold for roofers ascending and descending the stair step series. To provide stability; however, the security rope must be relatively tight under tension. Therefore, a ratchet roofing anchor is located near the eave of the roof, below but at a similar lateral position as the upper connection of the security rope. The ratchet anchor has a one-way clamping mechanism that allows the security rope to be pulled through the clamp until the rope is tight between the two anchors. The mechanism then clamps upon the rope so that the applied tension is maintained and the security rope is fixed relative thereto. A distal end of the security rope opposite the end connected near the roof's crown is allowed to dangle off of the roof toward the ground to at least a height reachable by all roofing personnel.

The security rope now provides a hand hold for ascending and descending roofer's, but it also provides a continuous point of connection to the safety system for those same roofers, provided there is a means provided for making a securing connection thereto from the roofers' safety lines. Such a connection is provided in the form of an ascender that slips along the rope in one direction, the upward direction, and clamps upon the rope in a downward direction unless the gripping mechanism is intentionally prevented from engaging. An insert aperture or hole is provided in the ascender for accommodating connection of the roofer's safety line. Through the use of the ascender, the roofers are able to be secured to the safety system from the time they make their connection thereto and leave the ground, until the time they reach the roof's crown and transfer their connection to the roof crown anchor assembly.

As mentioned, the ascender includes a grabbing or locking mechanism that engages the security rope when a generally downward force is applied to a ratchet mechanism of the ascender. The obvious purpose for such a mechanism being that should a roofer stumble or fall down the roof toward the ground, the ascender secures the roofer against the fall. By design, the ascender has a cylindrical body that creates a rope conduit therethrough. The security rope is inserted into the rope conduit at its lower free end for typically a friction fit therewith. Multiple ascenders may be employed, therefore all may be installed upon the rope and then the rope knotted at the free end to assure that the ascenders do not become disengaged therefrom under their own weight should they slip downward when not in use.

The benefits of using such an ascender are that the roofers are now continuously connected to the safety system during ascension and descent of the roof on the stair step system. Furthermore, the ascender makes negotiating the ascension and descent process much quicker since the roofer no longer needs to make individual connections to the step anchors themselves.

In the unlikely event that the ascender should fail during a roofer's fall, a restraining or catch line is provided proximate to the roof's eave and parallel thereto. The restraining rope is secured at either end by a ratchet roofing anchor within which ends of the rope are placed and pulled tight. The security rope is then either tied or looped around the catch line. Therefore,should the gripping action of the ascender fail, the ascender body will not pass beyond the loop or knot since this enlargement of the security rope will not pass through the rope conduit of the ascender's body. The restraining rope is positioned at a distance from the roof's eave approximately equal to, or greater than the length of the roofers' security lines. In this way, the security line will pull tight and restrain a falling roofer while he is still upon the roofs surface and before he drops over the eave's edge.

Once the roofer has ascended to the roof's crown and desires to traverse the entire length of the roof, he transfers his personnel hook from the ascender to the crown anchor spanning rope connected on the opposite side of the roof and extending from far opposite ends of the crown anchor assemblies. Connection to the spanning rope on the opposite side of the roof prevents the roofer's hook from encountering interference from other components of the crown anchor assemblies. This results because the spanning rope bows under the tension applied by the roofer toward the apex of the roof where there are no obstructions; therefore, the hook may be pulled along without hindrance.

Connection to this longer spanning rope should only be made by one roofer at a time. Typically, there will be one roofer who is working the entire length of the roof for such purposes as distributing shingles to the other roofers. The other roofers will be connected to the shorter crown anchor ropes on the same side of the crown that they are working. As with the longer spanning ropes, only one roofer should be connected to each crown anchor rope. The safety system is designed to distribute possible falling forces of the roofers across an entire roofing crown anchor assembly. This prevents high force concentrations that could result from having multiple roofers connected to the same ropes of the crown anchor assembly. By having the shingle bearing roofer connected to the longer spanning rope on the opposite side of the crown from shorter ropes to which his fellow workers are connected on the same side of the roof, the roofers' respective lanyards are deterred from interfering, one with the other and potentially becoming entangled.

Each roofer will have a working lanyard that is connectable to the roofing crown anchor assembly at a top end and having a length sufficient to drape at least as far down the roof as the restraining line. Normally, the length of this working lanyard will be at least thirty five feet long. It is expected that individual roofers will at some time be connected to each roofing crown anchor assembly and will roof the area therebelow. Therefore, to provide easy access to the area, the roofer's working lanyard is connected at its top end to the crown anchor assembly and looped or tied to the restraining line at a lower end. An ascender like those used on the security rope has been previously installed upon the working lanyard. The roofer connects his safety line to this ascender on the working lanyard and proceeds with roofing the area.

In the event that ridges of the roof intersect the crown and there are other areas to be roofed that do not extend down from the crown, satellite anchors may be employed that permit the roofers to access these areas while still being continuously secured to the safety system. The anchoring ability of the satellite anchors is enhanced by the roofing anchors belted attachment to a flat anchor plate that can be placed on an opposite side of the ridge from the roofing anchor of the satellite anchor assembly. It is not, however, required that the flat plate be on the opposite side of the ridge to be effective.

A spanning rope may be connected between two satellites to permit a roofer's attachment thereto similarly to his attachment to the crown anchor ropes at the crown anchor assembly. This attachment may include connection of the roofer's working lanyard, as long as a restraining rope is also employed.

It should be recognized that one of the only limitations to installation of the various components of the roofing safety system is that the installing roofer must remain physically connected to another securing component of the system while making such installation. As long as this requirement is met, the roofers may traverse the entire surface of the roof using the various components of the safety system in any combinations that provide the worker the desired access. To dismantle the safety system, the installation steps are reversed, remembering to assure that the roofers remain secured to at least one anchor that is still functionally mounted to the roof. The individual anchors embody several beneficial features in their construction. All but the ratchet roofing anchor are similarly constructed so that two or more similar anchors may be nested in a stacked fashion. This permits these components to be transported and stored in more compact groups. Along this same line, several of the anchors are based, or include as a component, the more generic roofing anchor. Examples of such anchors include the satellite anchor, the ratchet roofing anchor, and the end anchors of the roofing crown anchor assemblies. Furthermore, most of the components of the anchors are constructed from a single piece of metal that may be stamped or bent into the shape of an anchor. This reduces manufacturing costs, as well as simplifying construction. Still further, the anchor plates, connective belting,and ascender components are weather resistant.

Referring now to specific embodiments of the roofing safety system, additional benefits and advantageous features will be appreciated. One embodiment of the invention includes a roofing anchor for attachment to a pitched roof's upper surface and to which roofing personnel make releasable connections. The roofing anchor includes a base plate that has a lower surface that is at least partially planar. The lower surface is capable of abutting engagement with the top upper surface of the pitched roof. The anchor has an elevational extension member that is connected to the base plate in a fixed orientation. An engagement plate is connected to the elevational extension member also at a fixed orientation. Releasable connections are made to the engagement plate by roofing personnel. The engagement plate is located at an elevation that is greater than the elevation of the base plate above the roof's surface. Therefore, a clearance space is provided between the engagement plate and the roof's surface.

The roofing anchor also includes at least one engagement aperture through the engagement plate for receiving a personnel hook.

Each engagement aperture is substantially triangular in shape and is oriented so that one side of the triangular aperture is substantially parallel with an outside edge of the engagement plate.

In the embodiment of a ratchet roofing anchor, the roofing anchor additionally includes a releasable connector for the security rope or other cord of the system.

The releasable connector for the several ropes has a one-way clamp through which a rope may be inserted for slipping engagement in one direction and clamped engagement in an opposite direction.

The base plate of the anchor includes at least one securing aperture therethrough that is suitable for receiving a securing member therein.

Each of the securing apertures has a keyhole shape that includes a slot and one bulbous end.

The slot of each keyhole shaped securing aperture extends from the bulbous end away from the engagement plate.

The base plate also includes belting slots through which pliable belting is insertable for securement to the base plate.

Each of the belting slots is located adjacent and parallel to an edge of the base plate.

At least one belting slot is located at an end of the base plate opposite an end of the base plate to which the elevational extension member is connected and that belting slot is perpendicularly oriented to a lengthwise axis of the base plate.

At least one belting slot is located proximate to an end of the base plate to which the elevational extension member is connected and that belting slot is parallelly oriented to the lengthwise axis of the base plate.

The base plate is substantially rectangular in shape with a length of the base plate being greater than a width of the base plate.

The base plate, the elevational extension and the engagement plate are constructed from a single piece of sheet metal that is configured into the roofing anchor.

In the embodiment of a satellite anchor, a flat anchor plate is connected to the roofing anchor at the base plate by a pliable belt.

The belt is constructed from flexible woven belting that is sufficiently pliable to conform to contours of the roof's upper surface and the belt is connected to the base plate opposite the extension member.

Like the roofing anchor's base plate, the flat plate has at least one securing aperture therethrough suitable for receiving a securing member therein. The securing apertures are keyhole shaped and have a similar slot and bulbous end configuration.

In another embodiment, a roofing step anchor for attachment to a pitched roof's upper surface and to which roofing personnel make releasable connections and gain a foot hold are provided. The roofing step anchor includes a base plate having a lower surface that is at least partially planar and capable of abutting engagement with the upper surface of the roof. The step anchor has an angled extension member that is connected to the base plate at a fixed orientation therewith. The angled extension member has a personnel step engaging surface at an upper side of the angled extension member. There is also at least one brace connected to the angled extension member for maintaining the angled extension member in the fixed orientation during use by supporting at least a portion of the weight of a roofer who steps thereupon.

Each brace includes a foot member located distally from the angled extension member. The foot member is capable of, and designed for abutting engagement with the upper surface of the roof.

Each step anchor has a carrying handle.

The carrying handle includes an aperture through the brace and into which the hand of a roofer is insertable for carrying the roofing step anchor.

Like the roofing anchor, the step anchor has at least one engagement aperture, but it is through the angled extension member and is used for receiving a personnel hook that may be inserted therein.

The step anchor also has at least one securing aperture therethrough suitable for receiving a securing member therein. The securing apertures are keyhole shaped, having a slot and one bulbous end. The slot of each keyhole extends from the bulbous end away from the angled extension member.

Also like the roofing anchor, the base plate, the angled extension member and the brace are constructed from a single piece of sheet metal that is punched or bent into the configuration of the roofing step anchor.

Another embodiment is provided in the form of a roofing crown end anchor assembly for installment over the upper surface of the pitched roof's crown and to which roofing personnel make releasable connections for securement thereto. The roofing crown end anchor assembly includes a pair of end anchors that are located on opposite sides of the pitched roof's crown. Each pair of end anchors has a crown spanning belt that is connected between the two anchors and that extends over the pitched roof's crown. The crown spanning belt is constructed from pliable belting material that is substantially conformable to the upper surface of the pitched roof's crown. Each end anchor has a base plate with a lower surface that is at least partially planar and capable of abutting engagement with an upper surface of a roof. Each has an elevational extension member that is connected to the base plate at a fixed orientation therewith, and an engagement plate connected to the elevational extension member also at a fixed orientation therewith. Releasable connections may be made to the engagement plates by roofing personnel.

The end anchors of the end anchor assemblies are configured similarly to the roofing anchors described herein above.

In another embodiment, a one-way ascender for use by roofing personnel in a roofing safety system is provided. The one-way ascender includes a substantially cylindrical body that has an interior surface and an exterior surface. The body also has two open ends, one opposite the other. The two open ends establish an entrance port and an exit port through which a safety rope is insertable through the body. There is a ratchet member for allowing the rope to pass in a direction from the insert port to the exit port and for restraining movement of the rope in an opposite direction from the exit port to the insert port.

The one-way ascender provides a rope conduit formed within a substantially cylindrical interior space of the ascender body. The rope conduit is sized to accommodate a safety rope therein.

The ascender additionally includes a pivot pin and a restraining pin located upon the ratchet member at an interior end of the ratchet member and within the rope conduit. There is a ratchet member insert aperture extending through a bottom wall of the ascender body for allowing the ratchet member to be inserted therethrough. There is also a ratchet member restraining slot extending through a top wall of the ascender body for allowing the ratchet member to be partially inserted therethrough with the pivot and restraining pin retained within the rope conduit.

The entrance port and the exit port permit the safety rope to be inserted through the rope conduit.

The ratchet member has an interior end located within the ascender body and an exterior end located outside the ascender body. There is a coupler for coupling the ratchet member to the ascender body for relative pivotal movement therebetween.

Additionally included on the ratchet member is a protrusion extending from the interior end into the rope conduit for engaging a rope within the conduit so that a friction fit is established between an inserted rope and the one-way ascender thereby restricting relative movement therebetween.

The ratchet member further includes a toothed surface located adjacent to the protrusion for bitingly engaging an inserted rope when the toothed surface is depressed against the rope for restraining its movement in a direction from the exit port to the insert port.

The ratchet member also has a roofing personnel hook receiver located proximate to the exterior end of the ratchet member opposite the protrusion and the toothed surface. Furthermore, the ratchet member is oriented so that when tension is applied to the hook receiver in a direction generally parallel to a longitudinal axis of the ascender body and in a direction generally toward the entrance port from the exit port, the toothed surface is lifted in a direction away from the rope thereby relieving the restraining force of the toothed surface's engagement upon the rope.

Conversely, the ratchet member is further oriented so that when tension is applied to the hook receiver in a direction generally parallel to a longitudinal axis of the ascender body and in a direction generally toward the exit port from the entrance port, the toothed surface is depressed in a direction toward the rope thereby causing the rope to be fixed with respect to the rope conduit.

The hook receiver is an aperture extending through the exterior end of the ratchet member and the ascender is constructed from stainless steel to prevent corrosion as a result of weathering.

In yet another embodiment, a safety system for pitched roofs is provided. The system includes a stair step system comprising a series of roofing step anchors arranged for stepped engagement by a roofer. The series of roofing step anchors is oriented so that the series extends from an eave of the roof, upward toward a crown of the roof. There is also a roofing crown anchor assembly for installment over an upper surface of the pitched roof's crown and to which roofing personnel make releasable connections for securement thereto.

The safety system further includes an ascending cord or security rope anchored to the roof at each of two ends and positioned so that the cord extends adjacent to the stair step system.

The safety system further yet includes a one-way ascender connected to the ascending cord so that the ascender freely moves upward with an ascending roofer on the stair step system and clamps to the ascending cord when downward tension is applied to the ascender.

Additionally, a satellite anchor is included that may be positioned upon a roof ridge; the roof ridge being located proximate to the roofing crown anchor assembly so that a roofer can roof a surface other than those intersecting the crown over which the roofing crown anchor assembly straddles.

Each step anchor of the safety system is configured as described above.

Each roofing crown anchor assembly of the safety system is configured as described above.

Each one-way ascender of the safety system is configured as described above.

Another embodiment of the invention is a method for providing a roofing safety system for roofing personnel on pitched roofs. The method includes the steps of providing a roofing safety system installed upon a pitched roof and to which a roofer may be continuously connected while on the roof. The provision of such a system includes securing individual roof step anchors to an upper surface of the roof in a series and arranging the roof step anchor series into a stepping pattern from an eave of the roof toward a crown of the roof. A roofer progresses up the series of step anchors from an eave end of the series to a crown end of the series while maintaining a connection between himself and the series of step anchors as he traverses the series of step anchors. The process includes installing a roof crown anchor assembly upon a crown of the roof and then establishing a connection between the roofer and the roof crown anchor assembly so that the roofer may traverse the roof while being continuously connected to the roofing safety system.

The method further includes providing a redundant connection between the roofer and the safety system so that continuous connection therebetween is maintained.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

Figure 1:
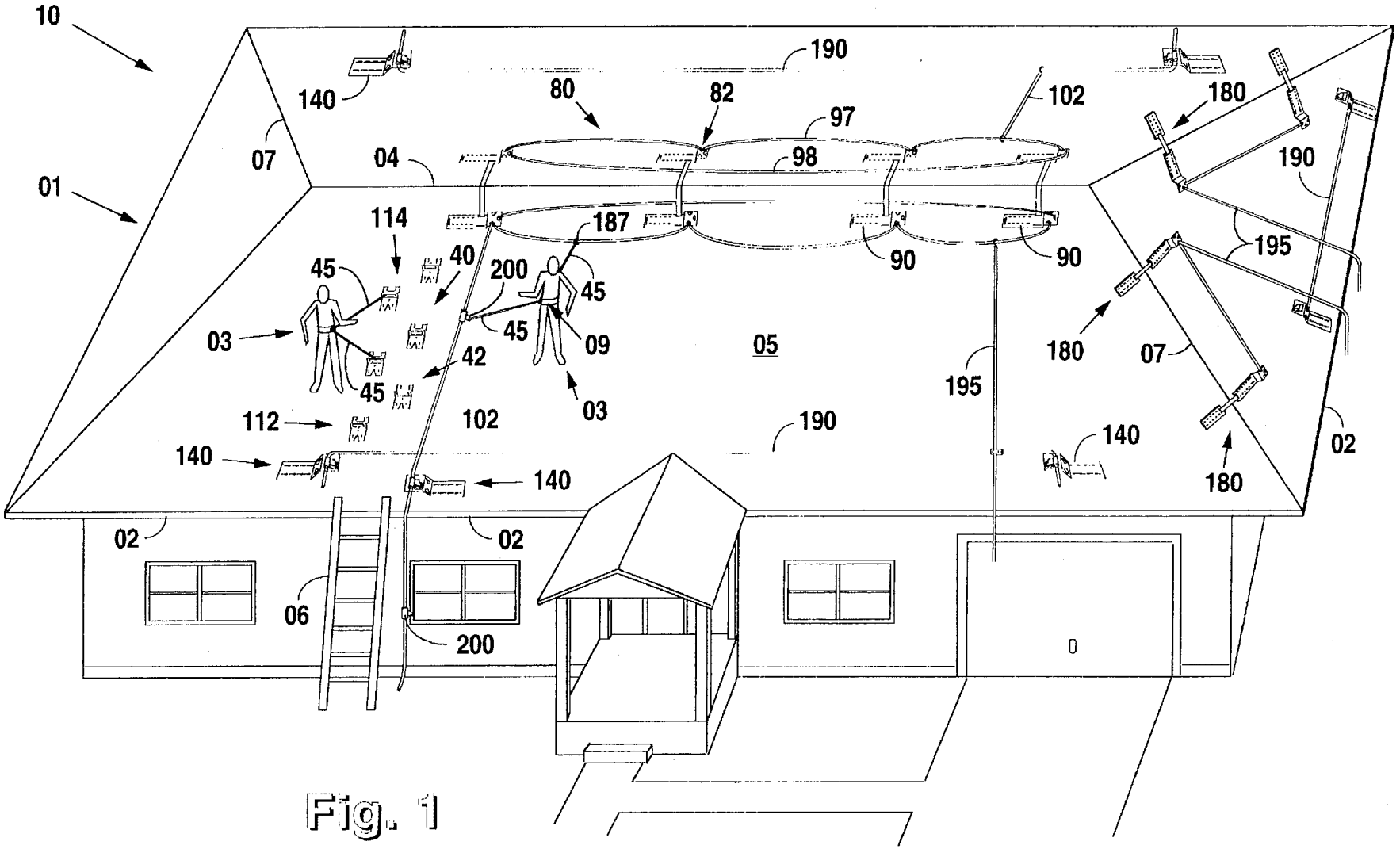
FIG. 1 is a perspective view of the safety system upon a pitched roof.

DETAILED DESCRIPTION OF THE INVENTION:

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Certain terminology will be used in the following description for convenience and reference only and will not be limiting. For example, the words "rightwardly", "leftwardly", "upwardly" and "downwardly" will refer to directions in the drawings to which reference is made. "Upward" and "downward" are also used to identify directions relative to the roof's surface and the ground. The words "inwardly" and "outwardly" refer to directions toward and away from, respectively, the geometric center of the structure being referred to. This terminology includes these words, specifically mentioned derivatives thereof, and words of similar import.

Furthermore, in the claims, elements have been recited as being "coupled"; the reason for such terminology's use is that it is anticipated that elements may be connected together in such a way that there may be other components interstitially located between the connected elements or that the elements may be connected in fixed or movable relation one to the other.

Figure 2:
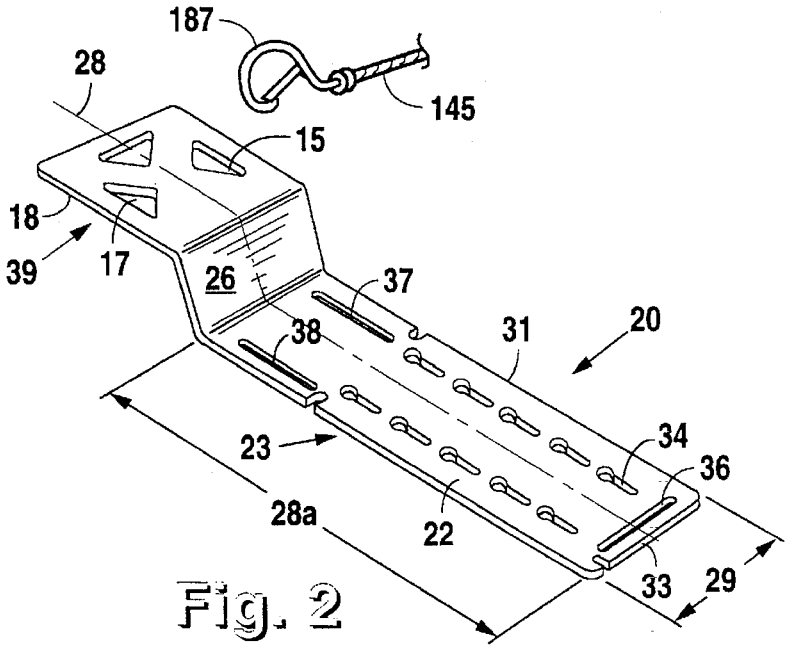
FIG. 2 is a perspective view of one embodiment of a roofing anchor and personnel hook and safety line.
Figure 6:
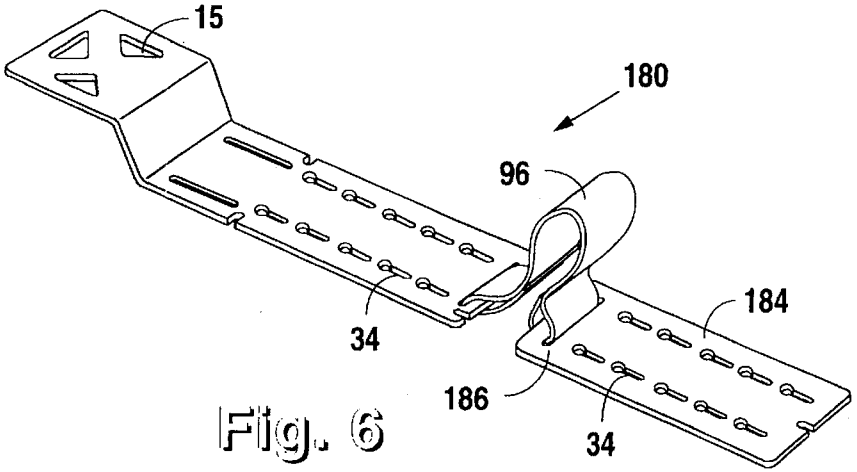
FIG. 6 is a perspective view of a satellite anchor.
Figure 5:
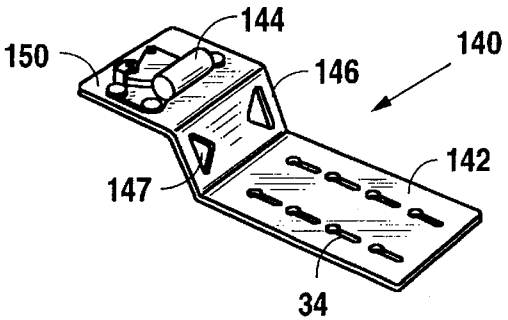
FIG. 5 is a perspective view of a ratchet roofing anchor.
Figure 14:
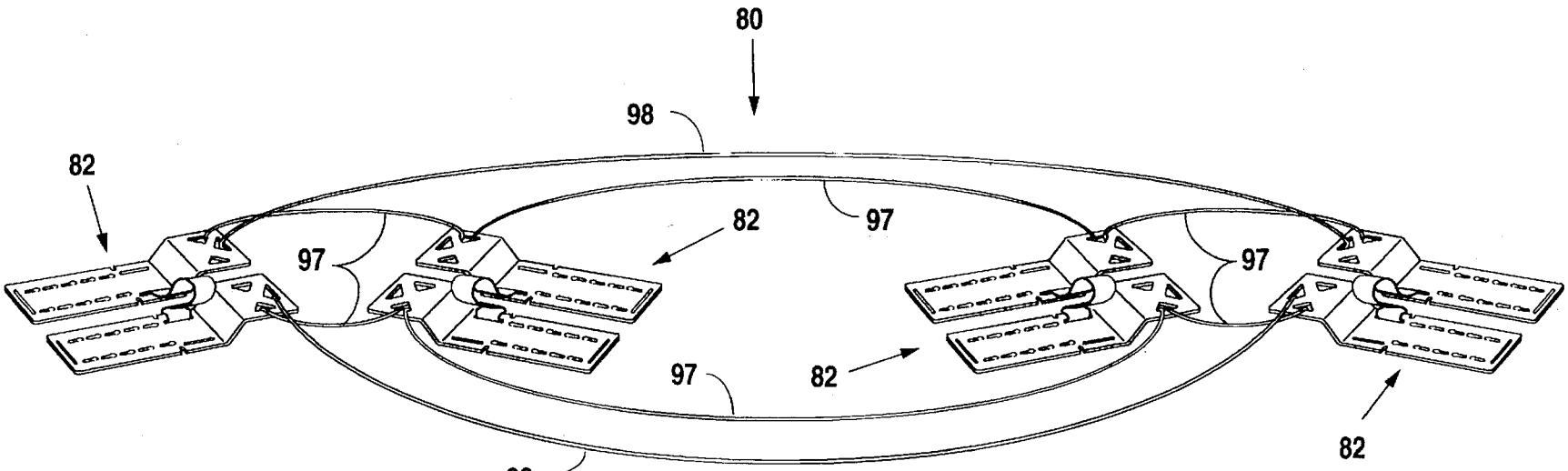
FIG. 14 is a perspective view of a roofing crown anchor assembly.
Figure 7:
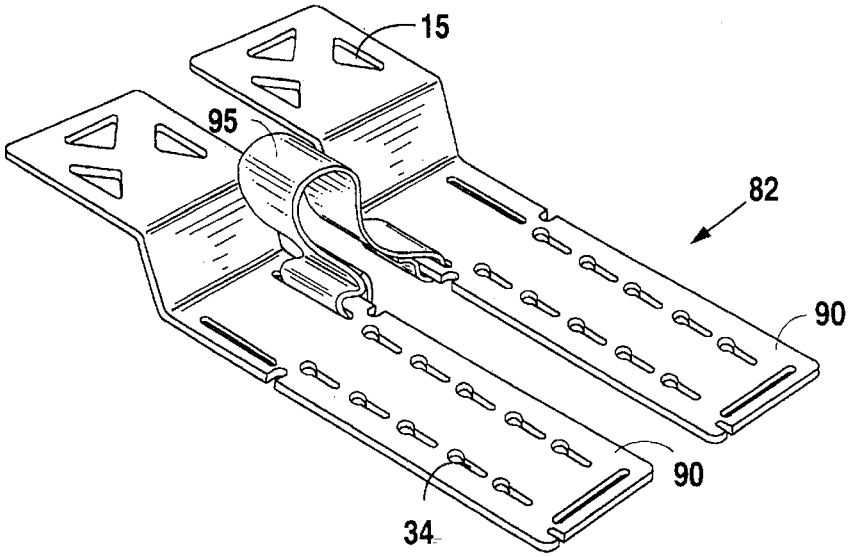
FIG. 7 is a perspective view of an end anchor assembly.
Figure 8:
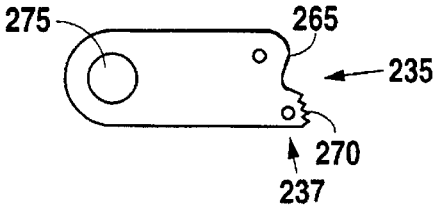
FIG. 8 is a side view of a ratchet member of an ascender.
Figure 9:
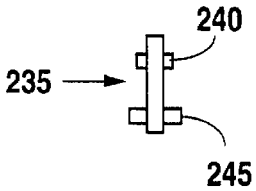
FIG. 9 is a top view of the ratchet member.
Figure 10:
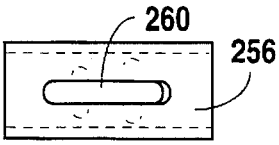
FIG. 10 is a top view of a body of the ascender.
Figure 11:
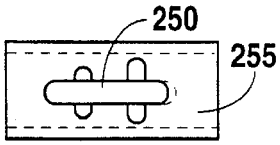
FIG. 11 is a bottom view of a body of the ascender.

The present invention is a roofing safety system 10 for pitched roofs 01 having several components for protecting roofing personnel 03. As shown generally in FIG. 1, a stair step system 40 and roofing crown anchor assembly 80 are included. Other components of roofing safety system 10 include several embodiments of roofing anchors. One embodiment of a roofing anchor is shown in FIG. 2 as roofing anchor 20. Another embodiment is shown in FIG. 5 as ratchet roofing anchor 140 where a releasable connector 144 is attached to engagement plate 150. A further embodiment is shown in FIG. 7 where two end anchors 90 are joined together by a crown spanning belt 95. An additional embodiment of a roofing anchor is shown in FIG. 6 as satellite anchor 180 that further comprises flat anchor plate 184 and satellite anchor belt 96.

Referring to FIG. 2, an embodiment of the roofing anchor 20 is illustrated. Roofing anchor 20 is comprised of a base plate 22, an elevational extension member 26, and an engagement plate 30. The elevational extension member 26 is connected in a fixed orientation with base plate 22, Engagement plate 30 is connected in a fixed orientation with elevational extension member 26. Plate 22, member 26, and plate 30 are preferably constructed from a single piece of sheet metal. It should be pointed out that roofing anchor 20 and other anchors of the safety system 10 for pitched roofs 01 can be manufactured from materials such as steel, angle iron, plastic, or other corrosive resistant materials that resist degradation when exposed to environment conditions.

Base plate 22 has a lower surface 23, a lengthwise axis 28 having a length 28*a* measured therealong, a width 29, an edge 31 and an end 33. The lower surface 23 is partially planer and abuts against upper surface 05 of roof 01. The length 28*a* is greater than the width 29.

Base plate 22 contains at least one securing aperture 34 which in the illustrated embodiment includes a plurality of securing apertures 34. As shown by FIG. 2, there are ten securing apertures 34 on the roofing anchor 20. Securing members 24, which in one embodiment are conventional headed nails, are used to secure the base plate 22 to the roof 01. Apertures 34 in base plate 22 are substantially the same as the apertures 34 in base plate 52 of roofing step anchor 50. Apertures 34 will be hereinafter described in further detail.

Base plate 22 also contains three belting slots 36, 37, and 38, each of which is oriented substantially parallel to an edge 31 of base plate 22. In the embodiment shown in FIG. 2, belting slot 36 is located at end 33 of base plate 22 perpendicular to lengthwise axis 28 and opposite to the elevational extension member 26. Belting slots 37 and 38 are oriented parallel to lengthwise axis 28 of base plate 22.

Engagement plate 30 is positioned by elevational extension member 26 at a greater elevation above roof 01 than base plate 22, thereby providing clearance space 39 between the engagement plate 30 and the upper surface 05 of the roof 01. In this embodiment, each engagement plate 30 has three engagement apertures 15 that can be used by roofers 03 to attach themselves to roofing anchor 20 or can be used to connect a pair of roofing crown end anchor assemblies 82 together to form roofing crown assembly 80 as shown in FIG. 1. The engagement apertures 15 are substantially triangular in shape and orientated so that a side 17 of the triangular aperture 15 is substantially parallel with an outside edge 18 of engagement plate 30.

Initially, the stair step system 40 is installed so the a roofer 03 can safely reach roof crown 04 where the roofing crown anchor assembly 80 is assembled. This is accomplished by installing a series of roofing step anchors 50 from roof eave 02 to roof crown 04.

Roofing personnel 03 reach roof eave 02 by a ladder 06. Roofing personnel 03 then nail a first roofing step anchor 50 to roof 01 while standing on ladder 06. A series of roofing step anchors 50 provide foot holds for ascending and descending roofers 03.

Figure 3:
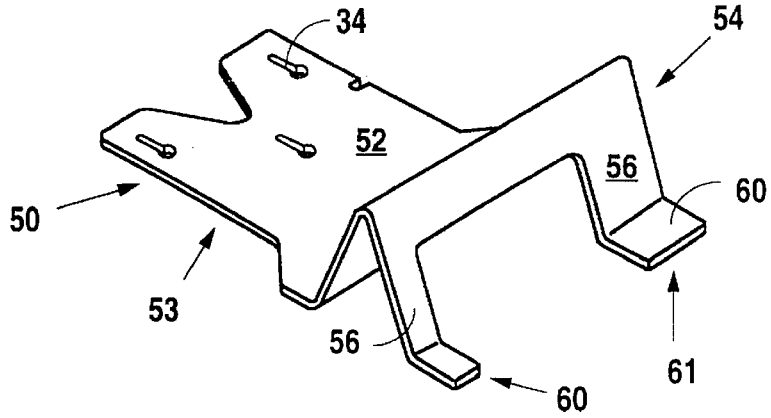
FIG. 3 is a perspective view of a roofing step anchor from the braced side.
Figure 4:
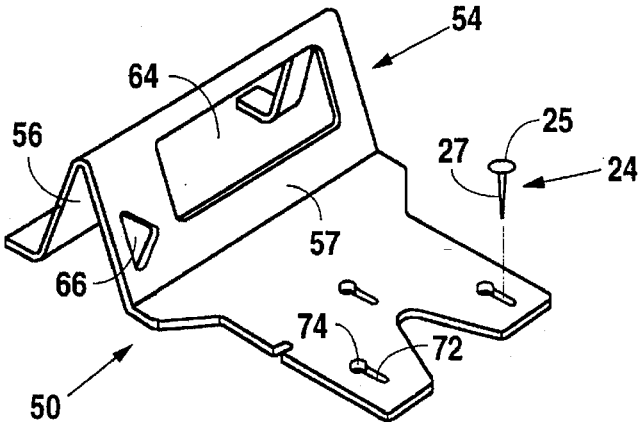
FIG. 4 is a perspective view of a roofing step anchor from the step engaging surface side.

Referring now to FIGS. 3 and 4, roof step anchor 50 is comprised of a base plate 52, an angled extension member 54, and at least one brace 56. Roof step anchor 50 is preferably made from a single piece of sheet metal. Roof step anchor 50 is installed by placing the base plate's 52 partially planer lower surface 53 flat against the pitched roof's 01 upper surface 05. Base plate 52 is pointed substantially toward roof crown 04.

Referring to FIG. 4, securing members 24, which include headed nails, are used to secure the base plate 52 to the upper surface 05 of the roof 01. Connected to the base plate 52 at a fixed orientation is the angled extension member 54. At an upper side of angled extension member 54 is a roofer step engaging surface 57. Referring to FIG. 3, at least one brace 56 is connected to angled extension member 54. The brace 56 supports a portion of the roofer's 03 weight to prevent deformation of the step anchor 50 and to prevent the base plate 52 from being disengaged from the upper surface 05 of the roof 01. In the illustrated embodiment, each step anchor 50 has two braces 56. These braces 56 have foot members 60, one each respectively. Each foot member 60 has a lower foot surface 61. Lower foot surface 61 is at least partially planer and provides additional stability to step anchor 50 by being capable of abutting engagement with the top upper surface 05 of the roof 01.

Referring to FIG. 4, angled extension member 54 contains carrying aperture 64 and engagement aperture 66. Carrying aperture 64 is designed to accommodate the hand of a roofer 03 and provide a carrying handle so that the step anchor 50 may be easily carried when not attached to roof 01. Engagement aperture 66 is designed to accommodate personnel hooks 187 that are attached to ends of safety lines 45. The safety line 45 is connectable to a safety harness 09 worn by a roofer 03 at its opposite end. The personnel hooks 187 and safety lines 45 are commercially available roofing safety equipment.

Like the base plate 22 of the roofing anchor 20, the base plate 52 of the step anchor 50 includes a plurality of securing apertures 34. Apertures 34 have a keyhole shape with a slot 72 on one end and a bulbous end 74 on the other. Slot 72 extends away from angled extension member 54. By hammering a nail having a head 25 and a shaft 27 into the narrow slot 72 of aperture 34, base plate 52 is secured to the upper surface 05 of the roof 01.

After a first step anchor 50 is nailed to roof 01, a second step anchor 50 is nailed generally diagonally toward roof crown 4 from first step anchor 50 as shown by FIG. 1. Additional step anchors 50 are nailed to the roof 01 in the same manner. To climb toward the roof crown 04, roofer 03 disconnects one safety line 45 from the previous step anchor 50 while remaining connected to the next anchor 50 by a second safety line 45. The roofer 03 continues progressing up the roof 01 in this alternating fashion as he proceeds toward roof crown 04. Once roofer 03 reaches roof crown 04, a series of step anchors 42 having an eave end 112 and a crown end 114 will be stationed from the roof eave 02 to the roof crown 04. Thus a stepping pattern is established as shown in FIG. 1. This stepping pattern allows subsequent roofing personnel 03 to use the step engaging surfaces 57 as foot holds to ascend and descend the roof 01. While ascending, they are continuously secured to the roof 01 by connecting and disconnecting from one step anchor 50 to the next as they ascend.

Once the roofer 03 reaches roof crown 04; the roofing crown anchor assembly 80 is installed. As shown by FIG. 1, roofing crown anchor assembly 80 is comprised of at least two end anchor assemblies 82 installed on the upper surface 05 of the roof crown 04. The end anchor assemblies 82 are positioned in opposing orientation, one to the other, and with a length of crown anchor rope 97 connected therebetween. In the embodiment shown, four crown anchor ropes 97 are used.

In the illustrated embodiment, two roof crown assemblies 80 are positioned along roof crown 04. These two roof crown assemblies 80 are identical. Two additional cords or ropes referred to as crown anchor spanning ropes 98 are used to connect the extreme distal ends of a series of crown anchor assemblies 80. These two longer spanning ropes 98 are positioned on opposing sides of roof crown 04. By using two or more roofing crown assemblies 80, a roofer 03 can now be secured to safety system 10 while traversing greater distances of the roof's 01 length.

The end anchor assemblies 82 are arranged into a mirrored orientation, one opposing the other. Therefore, only one end anchor assembly 82 will be described in detail herein. End anchor assembly 82 includes two end anchors 90 that are connected at their sides by crown spanning belt 95. One embodiment of the end anchor 90 is illustrated as a roofing anchor 20 in FIG. 2. When two roofing anchors are joined at their sides by the crown spanning belt 95 and mounted over the crown 04, however, they form an end anchor assembly 82.

Crown spanning belt 95 connects the pair of end anchors 90 at belting slots 37 and 38. Belt 95 is made from a sufficiently pliable material such as nylon belting that conforms to the shape of roof crown 04 when installed thereupon. To construct end anchor assembly 82, belt 95 is extended through slot 37 of one end anchor 90 and slot 38 of the other end anchor 90. Belt 95 is then sewn upon itself at each end securing the end anchors 90 together.

To install end anchor assembly 82, the base plate 22 of each end anchor 90 is secured to roof crown 04 by hammering nails through apertures 34 in the same manner as used with the step anchors 50. Each end anchor 90 is positioned as shown in FIG. 1 on opposite sides of the crown 04.

Once the first end anchor assembly 82 is installed, a second end anchor assembly 82 is installed at a distance therefrom. The second end anchor assembly 82 is installed in the same manner as the first end anchor assembly 82, except the engagement plates 30 of the second end anchor assembly 82 are oriented to face the engagement plates 30 of the first end anchor assembly 82.

Once a first roofing crown anchor assembly 80 is installed, a roofer 03 can use personnel clips 187 to connect himself to rope 98 of crown anchor assembly 80. This connection allows a roofer 03 to move vertically and longitudinally across roof 01. Each roofer 03 is outfitted with a harness 09 to which one end of each of his or her safety lines 45 will be connected. The opposite, and usually hooked end of the line 45 may be connected to the system 10 at the provided locations.

A working lanyard 195 may also be used that is longer than the safety lines 45 and allows access to greater portions of the roof.

To speed access to roofing crown anchor assembly 80, a ratchet roofing anchor 140 is installed proximate to roof eave 02. Roofing anchor 140 has a base plate 142, elevational extension member 146, and engagement plate 150. In the illustrated embodiments, several of the components of the ratchet roofing anchor 140 are similar to the roofing anchor 20. The parts may, however, differ from the roofing anchor 20 in slight ways. One difference is that the base plate 142 of ratchet roofing anchor 140 has eight securing apertures 34 and no belting slots, while roofing anchor 20 has ten apertures 34 and three belting slots 36, 37 and 38. Another difference is that elevational extension member 146 has two engagement apertures 147, while elevational extension member 26 has no engagement apertures. An additional difference is that engagement plate 150 does not have an engagement aperture therethrough, while engagement plate 30 has three apertures 15. A releasable connector 144 for engaging a security rope 102, however, is attached to engagement plate 150. Releasable connector 144 may be positioned either perpendicularly or parallelly to a lengthwise axis of base plate 142. The releasable connector 144 is a one-way clamp 144 that allows security rope 102 to slip in one direction while retarding movement in an opposite direction. This allows the security rope 102 to be pulled through the clamp 144 until sufficient tension is placed on the rope 102. The clamp 144 secures the rope 102 at that position thereby maintaining the applied tension until later released.

As shown in FIG. 1, ratchet roofing anchor 140 is installed at eave 02 of roof 01 adjacent to the stair step system 40 by hammering nails into apertures 34 in the same manner as used to secure the step anchors 50. A security rope 102 is hooked to an end anchor 90 of roofing crown assembly 80 and extended downward to roofing anchor 140. Rope 102 is than clamped and secured into connector 144. By clamping one end of rope 102 to anchor 140 at eave 02 while the other end of rope 102 is secured to an end anchor 90 at crown 04, the security rope 102 establishes an ascending cord that extends along the side of stair step system 40.

Rope 102 can be used for several different purposes. One purpose is to provide a hand hold for stability to roofers 03 ascending and descending stair system 40. Another purpose is to be used in conjunction with a one-way come-along or ascender 200 that may be connected to ascending cord 102 so that roofer 03 may ascend quickly but be protected from downward falls.

Figure 12:
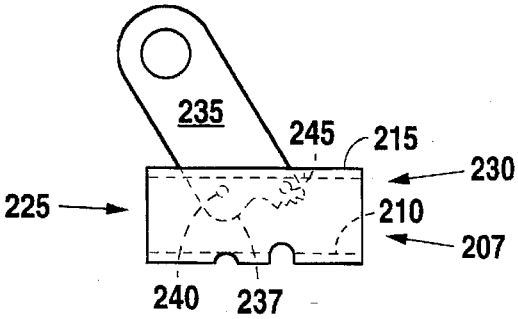
FIG. 12 is a side view of the ascender showing features within the ascender body in phantom.
Figure 13:
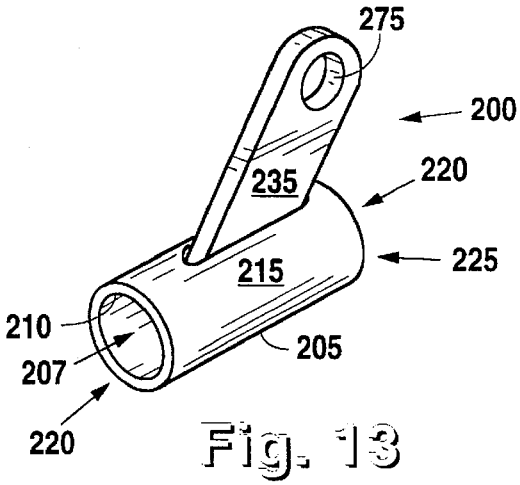
FIG. 13 is a perspective view of the ascender.

FIG. 13 illustrates the ascender's 200 two primary components; a cylindrical body 205 and ratchet member 235. The body 205 has an interior surface 210 and an exterior surface 215. The interior surface 210 creates a tubular rope conduit 207. The body 205 has two open ends 220 that establish and entrance port 225 and exit port 230 to the conduit 207. When assembled together, the ratchet member 235 has an interior end 237 that extends into and remains within the body 205. When a rope is inserted into the rope conduit 207, the interior end 237 of the ratchet member creates a friction connection therebetween tending to restrict the ropes passage through the conduit 207. Located upon the interior end 237 is protrusion 265 and toothed surface 270. The ratchet member 235 includes a pivot pin 240 and restraining pin 245 located at the interior end 237. To install the ratchet member 235 in the body 205, the ratchet member 235 is inserted through an insert aperture 250 that extends through a bottom wall 255 of the body 205. Notches are provided to allow the pins 240 and 245 to also pass therethrough. An upper end opposite the interior end 237 exits the body 205 through a top wall 256 at restraining slot 260. The interior end 237 of the ratchet member 235 is trapped within the body 205 because the pins 240 and 245 will not pass through the restraining slot 260. The upper end of the ratchet member 235 has a hook receiver 275 or aperture extending therethrough for accommodating a personnel hook 187. As shown in FIGS. 12 and 13, the ratchet member 235 is normally positioned in a slanted orientation with respect to the body 205. With the ascender 200 installed upon a rope and a roofer 03 connected thereto by a hooked safety line 45, the ascender will follow the roofer 03 along the rope's length as long as tension is applied to the hook receiver 275 in a generally leftward direction in the embodiment illustrated in FIG. 12. In operation, with tension applied in this direction the restraining pin 245 is pressed against the interior of the top wall 256 and only the protrusion 237 contacts the rope retained therein, if any portion at all is in contact therewith. In general, this mode is considered a released configuration since the toothed surface 270 is not engaging the rope. In the event that tension is applied to the hook receiver 275 in an opposite direction, or rightwardly with respect to FIG. 12, the ascender 200 clamps down on the rope in a restraining mode. During the restraining process, the toothed surface 270 is depressed down toward the rope and into engagement therewith as the toothed surface 270 pivots about the pivot pin. The more pressure that is applied to the ratchet member 235 in this direction, the greater the pivot force and therefore the more surely the ascender 200 clamps thereto. To permit the ascender 200 to act as a catch device for failing roofers 03, it is oriented so that the leftward end of FIG. 12 is positioned toward the crown 04 of the roof 01, and the rightward end is oriented toward the eave 02. In a preferred embodiment, the ascender 200 is constructed from stainless steel for strength and corrosion resistance.

Once roofing anchor 140 is installed, ascender 200 is connected to rope 102 at the ground level or at the eave 02 of roof 01. A roofer 03 climbing roof 01 connects ascender 200 to his harness 09. The ascender 200 travels upward with the roofer 03 along security rope 102. If the roofer 03 should fall backwards, ascender 200 will lock onto security rope 102 to prevent a backwards fall. A restraining or catch line 190 is included approximately parallel to the roof's 01 eave 02. The catch line 190 is either looped or tied with security rope 102 at their intersection(s). The line 190 is positioned at a distance upward from the eave 02 greater than a length of the safety lines 45. In this manner, should the ascender 200 fail under the force of a roofer's 03 fall, the ascender 200 will catch at the ropes' 102 and 190 intersection and prevent the roofer 03 from falling from the roof's 01 surface 05. Once the roofer 03 reaches crown 04, he can connect one of his safety lines 45 onto crown assembly 80.

The catch line 190 may be similarly utilized with the working lanyards 195. When the lanyard 195 is joined to the catch line 190, not only is an enlargement created that prevents passage of the ascender 200, but it also secures the lanyard 195 from flailing about in an unsecured manner on the roof's 01 surface 05.

The safety system 10 includes another embodiment of a roofing anchor in the form of satellite anchor 180 as shown in FIG. 6. This satellite roofing anchor 180 includes in combination a roofing anchor 20 and a flat anchor plate 184 connected by a satellite anchor belt 96. The belt 96, which is similar in construction to crown anchor belt 95, is connected to the base plate 22 opposite elevational extension member 26 through belting slot 36. Flat anchor plate 184 has a belting slot 186 that extends through anchor plate 184. The belt 96 is inserted through the slot 186 and sewn upon itself to create the connection. Like the crown spanning belt 95, the satellite anchor belt 96 is sufficiently pliable to conform to the contours of the roof 01. When satellite anchor 180 is situated on crown 04, base plate 22 may be placed on an opposite side of a roof ridge 07 from flat anchor plate 184. Flat anchor plate 184 has a plurality of securing apertures 34. The illustrated embodiment of the flat anchor plate 184 has ten apertures 34 structurally similar to the securing apertures 34 of the step anchors 50 and roofing anchors 20. Furthermore, the flat anchor plate 180 is secured to roof 01 by hammering nails through apertures 34 in the same manner as used with the step anchor 50. Satellite anchor 180 can be used individually on the ridge 07 of a roof 01 for repairing areas not needing the use of the entire roofing crown anchor assembly 80 or can be used in conjunction with a roofing crown anchor assembly 80 to reach areas proximate to adjacent ridges 07 of the roof crown 04. As shown at the right-hand side of figure 1, it is also contemplated that ropes may be connected between satellite anchors for receiving personnel hooks 187 thereby allowing a roofer to traverse the area between and below the satellite anchors 180.

It is also contemplated that a single roofing anchor 20 may be used in areas requiring access to a small portion of roof 01. The roofing anchor 20 is secured near the area to be repaired and that can be reached while being connected to the safety system at another location by a safety line 45. The roofing anchor 20 is secured to the roof 01 by securing nails in the apertures 34 of the base plate 22. A roofer 03 can then secure himself to one of the engagement apertures 15 before beginning repairs.

Once the roofing job has been completed, the components of roofing safety system are removed. The roofing anchors 20 and step anchors 50 are removed in basically the same fashion. To remove a roofing anchor 20, the claw of a hammer may be placed under engagement member 30. By pulling upward with the hammer, roofing anchor 20 will dislodge nails 24 slightly upward with respect to the roof's 01 surface 05. Next, the roofing anchor 20 is slid forward away from the engagement plate 30 so that the flanged head 25 of the nail is positioned over the bulbous portion 74 of aperture 34. The bulbous portion 74 is sufficiently large that the head 25 does not engage base plate 22 and passes therethrough as the roofing anchor 20 is lifted upward from roof 01. After the various roofing anchors are removed, the nails 24 can be hammered into roof 01, thereby plugging any holes that may have been created. Step anchor 50 is removed in the same manner, except the claw of the hammer is placed under the angled extension member 54 instead of under the engagement member 30.

A roofing safety system and its components have been described herein. These and other variations, which will be appreciated by those skilled in the art, are within the intended scope of this invention as claimed below. As previously stated, detailed embodiments of the present invention are disclosed herein; however, it is to be understood that the disclosed embodiments are merely exemplary of the invention that may be embodied in various forms.

What is claimed and desired to be secured by Letters Patent is as follows:

1. A one-way ascender for use by roofing personnel in a roofing safety system, said one-way ascender comprising:

a substantially cylindrical body, said body having an interior surface and an exterior surface;

said body having two open ends, one opposite the other;

said two open ends establishing an entrance port and an exit port through which a safety rope is insertable through said body; and a ratchet member for allowing the rope to pass in a direction from said insert port to said exit port and for restraining movement of the rope in an opposite direction from said exit port to said insert port, a rope conduit formed within a substantially cylindrical interior space of said ascender body, said rope conduit being sized to accommodate a safety rope therein, a pivot pin and a restraining pin located upon said ratchet member and within the rope conduit; a ratchet member insert aperture extending through a bottom wall of said ascender body for allowing said ratchet member to be inserted therethrough; and a ratchet member restraining slot extending through a top wall of said ascender body for allowing said ratchet member to be partially inserted therethrough with said pivot and restraining pin retained within said rope conduit.

2. The one-way ascender for use by roofing personnel in a roofing safety system as recited in claim 1, wherein said entrance port and said exit port permit the safety rope to be inserted through said rope conduit.

3. The one-way ascender for use by roofing personnel in a roofing safety system as recited in claim 2, wherein said one-way ascender further comprises:

said ratchet member having an interior end located within said ascender body and an exterior end located outside said ascender body; and a coupler for coupling said ratchet member to said ascender body for relative pivotal movement therebetween.

4. The one-way ascender for use by roofing personnel in a roofing safety system as recited in claim 3, wherein said ratchet member further comprises:

a protrusion extending from said interior end into said rope conduit for engaging a rope within said conduit so that a friction fit is established between an inserted rope and said one-way ascender thereby restricting relative movement therebetween.

5. The one-way ascender for use by roofing personnel in a roofing safety system as recited in claim 4, wherein said ratchet member further comprises a toothed surface located adjacent to said protrusion for bitingly engaging an inserted rope when depressed thereagainst for restraining said rope's movement in a direction from said exit port to said insert port.

6. The one-way ascender for use by roofing personnel in a roofing safety system as recited in claim 5, wherein said ratchet member further comprises:

a roofing personnel hook receiver located proximate to said exterior end of said ratchet member opposite said protrusion and said toothed surface; and said ratchet member being oriented so that when tension is applied to said hook receiver generally parallel to a longitudinal axis of said ascender body and in a direction generally toward said entrance port from said exit port, said toothed surface is lifted in a direction away from said rope thereby relieving the restraining force of said toothed surface's engagement upon the rope.

7. The one-way ascender for use by roofing personnel in a roofing safety system as recited in claim 6, wherein said ratchet member is further oriented so that when tension is applied to said hook receiver generally parallel to a longitudinal axis of said ascender body and in a direction generally toward said exit port from said entrance port, said toothed surface is depressed in a direction toward said rope thereby causing said rope to be fixed with respect to said rope conduit.

8. The one-way ascender for use by roofing personnel in a roofing safety system as recited in claim 7, wherein said hook receiver is an aperture extending through said exterior end of said ratchet member.

9. The one-way ascender for use by roofing personnel in a roofing safety system as recited in claim 8, wherein said ascender is constructed from stainless steel to prevent corrosion as a result of weathering.

* * * * *